US007032716B2

(12) United States Patent
Meyle et al.

(10) Patent No.: US 7,032,716 B2
(45) Date of Patent: Apr. 25, 2006

(54) DESTINATION SELECTION CONTROL FOR ELEVATOR INSTALLATION HAVING MULTIPLE ELEVATOR CARS

(75) Inventors: Peter Meyle, Pliezhausen (DE); Stefan Schneider, Filderstadt (DE); Gerhard Thumm, Filderstadt (DE)

(73) Assignee: ThyssenKrupp Elevator AG, Duesseldorf (DE)

( * ) Notice: Subject to any disclaimer, the term of this patent is extended or adjusted under 35 U.S.C. 154(b) by 0 days.

(21) Appl. No.: 11/118,127

(22) Filed: Apr. 28, 2005

(65) Prior Publication Data

US 2005/0189181 A1 Sep. 1, 2005

Related U.S. Application Data

(63) Continuation of application No. PCT/EP2002/013324, filed on Nov. 26, 2002.

(51) Int. Cl.
*B66B 1/20* (2006.01)
*B66B 9/00* (2006.01)

(52) U.S. Cl. ..... 187/382; 187/249; 187/389

(58) Field of Classification Search ..... 187/247–249, 187/391–396, 313, 380–389, 902
See application file for complete search history.

(56) References Cited

U.S. PATENT DOCUMENTS 4,852,696 A * 8/1989 Fukuda et al. ..... 187/392
5,419,414 A * 5/1995 Sakita ..... 187/391
5,663,538 A * 9/1997 Sakita ..... 187/382
5,789,715 A * 8/1998 Kakko et al. ..... 187/397
5,877,462 A * 3/1999 Chenais ..... 187/249
6,003,637 A * 12/1999 Kim et al. ..... 187/391
6,273,217 B1 * 8/2001 Hikita ..... 187/388
6,360,849 B1 3/2002 Hikita (Continued)

FOREIGN PATENT DOCUMENTS

JP 04169484 A * 6/1992

OTHER PUBLICATIONS

*Patent Abstracts of Japan*, Abstract of Japanese Publication No. 08 133611, "Elevator Control Device," vol. 1996, No. 09 May 28, 1996.

(Continued)

*Primary Examiner*—Jonathan Salata
(74) *Attorney, Agent, or Firm*—Lipsitz & McAllister, LLC

(57) ABSTRACT

The invention relates to a method for controlling an elevator installation with at least one shaft and a number of cars, it being possible to make at least two cars travel separately up and down along a common traveling path and a passenger being able to enter a destination call by means of an input unit disposed outside the shaft and the destination call being allocated to a car in dependence on an allocation assessment. To develop the method in such a way that the transporting capacity can be increased, with the cars which can be made to travel along a common traveling path hindering one another as little as possible, it is proposed according to the invention that, in the case of allocation of the destination call to one of the cars which can be made to travel along the common traveling path, the portion of the traveling path required for serving the destination call is assigned to this car and blocked for the time of the assignment for the other cars. Furthermore, an elevator installation for carrying out the method is proposed.

27 Claims, 2 Drawing Sheets

U.S. PATENT DOCUMENTS

| | | | | |
|---|---|---|---|---|
| 6,364,065 | B1 | 4/2002 | Hikita | |
| 6,394,231 | B1 * | 5/2002 | Schuster et al. | 187/382 |
| 6,550,587 | B1 * | 4/2003 | Yuasa et al. | 187/394 |
| 2001/0035314 | A1 * | 11/2001 | Yoshida et al. | 187/382 |
| 2003/0164267 | A1 * | 9/2003 | Hikita | 187/391 |

OTHER PUBLICATIONS

*Patent Abstracts of Japan*, Abstract of Japanese Publication No. 2002220164, "Elevator Group Supervisory Control System," vol. 2002, No. 12 Aug. 6, 2002.

* cited by examiner

DESTINATION SELECTION CONTROL FOR ELEVATOR INSTALLATION HAVING MULTIPLE ELEVATOR CARS

This application is a continuation of international application number PCT/EP2002/013324 filed on Nov. 26, 2002.

The present disclosure relates to the subject matter disclosed in international application PCT/EP2002/013324 of Nov. 26, 2002, which is incorporated herein by reference in its entirety and for all purposes.

BACKGROUND OF THE INVENTION

The invention relates to a method for controlling an elevator installation with at least one shaft and with a number of cars which each have an associated drive and brake, it being possible to make at least two cars travel separately up and down along a common traveling path, a passenger entering a destination call with a travel destination by means of an input unit of a control device of the elevator installation disposed outside the at least one shaft and an allocation assessment then being performed for each car, the allocation assessments of all the cars being compared with one another and the destination call being allocated to the car with the best allocation assessment to serve it.

The invention also relates to an elevator installation, in particular for carrying out the method, with at least one shaft and with a number of cars which each have an associated drive and brake, it being possible to make at least two cars travel separately up and down along a common traveling path, and with input units disposed outside the at least one shaft for entering a destination call and also with a control device for controlling the cars, it being possible for an allocation assessment to be carried out by means of the control device for the individual cars after each time a destination call is entered and for the destination call to be allocated to a car.

In order to transport large number of persons and/or loads within a short time by means of an elevator installation, it is proposed in U.S. Pat. No. 6,360,849 to make two cars travel up and down along a common traveling path within a shaft. Outside the shaft a passenger can enter a destination call into a control device of the elevator installation, with which he indicates his travel destination. The control device then respectively carries out an allocation assessment for the two cars and allocates the destination call to the car with the best allocation assessment.

It is an object of the present invention to develop a method of the type stated at the beginning in such a way that the transporting capacity can be increased and shaft space can be saved, with the cars which can be made to travel along a common traveling path hindering one another as little as possible.

SUMMARY OF THE INVENTION

This object is achieved in the case of a method of the generic type according to the invention by providing that, in the case of allocation of the destination call to one of the cars which can be made to travel along a common traveling path, the portion of the traveling path required by the allocated car to serve the destination call is assigned to this car and the assigned portion of the traveling path is blocked for the time of the assignment for the other cars which can be made to travel along the common traveling path.

In the case of the method according to the invention, after entry of a destination call, an allocation assessment of the destination call is performed for each of the cars of the elevator installation that are in operation, in dependence on the operating data and the operating state of the respective car. On the basis of the allocation assessment, the destination call is then allocated to the car with the best allocation assessment, so that it can serve the destination call. If it is a car which is sharing a traveling path with at least one further car, it is provided according to the invention that the portion of the traveling path required for the allocated car to serve the destination call is assigned to this car, while it is blocked during the time of the assignment for the other cars which can be made to travel along the common traveling path. The portion of the traveling path required to serve the destination call is understood here as meaning the portion of the traveling path which, beginning from the current position of the car serving the destination call, extends via the starting point to the destination point of the travel desired by the passenger. This portion of the traveling path is consequently "reserved" for serving the destination call by the car to which the destination call is allocated, so that another of the cars which can be made to travel along the common traveling path cannot enter this portion of the traveling path during the time of the existing assignment, that is during the time in which the destination call is being served. The common traveling path is understood here as meaning a common traveling path of at least two cars within one shaft, that is a region of the shaft which is used for traveling along both by a first car and by at least a second car. Within this region it is possible that the at least two cars can be made to travel along common guide rails, but it may also be provided that the at least two cars have separate associated guide rails along the common traveling path. The use of at least two cars in one shaft allows shaft space to be saved and at the same time a high transporting capacity to be achieved.

As mentioned at the beginning, the allocation assessments performed for each car are compared with one another, in order that subsequently the entered destination call can be allocated to the car with the best allocation assessment. It is of advantage here to exclude from the comparison of the allocation assessments those cars for which the portion of the traveling path respectively required for serving the current destination call overlaps at least partly a portion of the traveling path which has already been assigned to another car on the basis of an earlier, not yet served destination call. Before the comparison of the allocation assessments, in the case of a control method of such a form it is in the first instance checked for each of the cars which can be made to travel along a common traveling path whether the portion of the traveling path required for this car to serve the destination call overlaps a portion of the traveling path which has already been assigned to another of the cars which can be made to travel along the common traveling path. The current destination call could consequently not been served by this car which can be made to travel along the common traveling path, and this car is therefore excluded from the comparison of the allocation assessments of all the cars of the elevator installation.

If the portion of the traveling path respectively required for serving a current destination call does not overlap any portion of the traveling path already assigned to a car, it is advantageous if in the first instance only the allocation assessments of the cars which can be made to travel along the common traveling path are compared with one another and then only the car with the best allocation assessment of these cars is used for the comparison with the allocation assessment of the remaining cars. Consequently, in the case of such a form of the method according to the invention, in the first instance an allocation assessment for the cars which can be made to travel along a common traveling path is only performed if the current destination call can in principle be served by all these cars. Of the cars which are sharing a common traveling path, then only the car with the best allocation assessment is used for the comparison with the allocation assessments of the remaining cars, while the other cars which can be made to travel along the common traveling path are excluded from this comparison. It has been found that, in the case of such a procedure, the allocation of an entered destination call to a specific car can be carried out particularly quickly. This makes it possible after a destination call has been entered to respond to a passenger within a very short time with a reply indicating which car and/or which shaft of the elevator installation he is to use to reach his entered travel destination.

If the current destination call can in principle be served by all the cars which are sharing a common traveling path, it is advantageous if each of these cars is provisionally assigned the portion of the traveling path required to serve the current destination call, then the results of the allocation assessments of these cars are compared with one another and then the provisional assignment of the portions of the traveling path is revoked with the exception of the car with the best allocation assessment, and, when the current destination call is allocated to the car which can be made to travel along the common traveling path that has the best allocation assessment of these cars, this car is definitively assigned the respective portion of the traveling path and, when the current destination call is not allocated to this car, its provisional assignment of the respective portion of the traveling path is cancelled. In the case of such a procedure, the assignment of a portion of the traveling path to one of the cars which can be made to travel along a common traveling path takes place in two stages, as long as the current destination call can in principle be served by each of these cars. In a first stage, each of these cars is provisionally assigned the portion of the traveling path respectively required for serving the destination call. Subsequently it is checked which of the cars sharing a common traveling path has the best allocation assessment. Its provisional assignment remains in existence until the current destination call has been allocated to a car, while the provisional assignments of the other cars are revoked as soon as it is established which of the cars sharing a common traveling path has the best allocation assessment. If the destination call is finally allocated to the car which shares its traveling path with other cars, then in the second allocation stage the portion of the traveling path required for this car is definitively assigned to the car. If the allocation of the current destination call is made to a car which does not share its portion of the traveling path with a further car, the provisional assignment of the car which can be made to travel along a common traveling path is cancelled. Consequently once the allocation of an entered destination call has been made there is a clear situation for the cars which can be made to travel along a common traveling path to the extent that either a portion of the common traveling path has been assigned to one of the cars or else the current destination call does not result in any "reservation" of a portion of the traveling path for the cars which can be made to travel along a common traveling path.

As already explained, in the case of a preferred embodiment of the method according to the invention it is provided that, after a destination call has been entered, the portion of the traveling path respectively required for serving the destination call is provisionally assigned to the cars which can be made to travel along a common traveling path, in order subsequently to compare the allocation assessments of these cars with one another. In this respect it has proven to be advantageous to exclude from the comparison of the allocation assessments of the cars which can be made to travel along a common traveling path those cars for which the portion of the traveling path respectively required for serving a current destination call overlaps at least partly a portion of the traveling path which has been provisionally assigned to one of the cars which can be made to travel along the common traveling path on the basis of an earlier destination call not yet allocated to a specific car. In the case of such a procedure, it is checked for the cars which can be made to travel along a common traveling path before the comparison of their allocation assessments whether there already exists a provisional assignment of a portion of the traveling path which would be overlapped when a current destination call is served by the portion of the traveling path required for this purpose. If this is the case, the respective car is no longer considered in the allocation of the current destination call, that is to say it is excluded from the comparison of the allocation assessments of the cars.

In the case of a particularly preferred embodiment of the method according to the invention, a portion of the traveling path which has been assigned to a car is released again floor by floor for the other cars when the destination call is served. As a result, the freedom of movement of the cars which can be made to travel along the common traveling path can be increased, since, during the serving of a destination call, the portion of the traveling path assigned to one of these cars is released floor by floor as soon as the car serving the destination call has left the respective floor.

If the elevator installation is used in a building which is occupied in such a way that, starting from a particularly frequented floor, for example a parking deck, the occupancy of the building takes place both upward and downward, it has proven to be advantageous if at least one of the cars which can be made to travel along a common traveling path is assigned a preferential region of the common traveling path and the position of the portion of the traveling path required for serving a destination call in relation to the respective preferential region is taken into consideration in the allocation assessment. This makes it possible for the traveling path shared by a number of cars to be divided up in such a way that one of the cars serves an upper part of the building with preference and another car serves a lower part of the building with preference, without excluding the possibility that, in the event of high user frequency of the lower part of the building, the car serving the upper part of the building with preference will also serve this lower part of the building.

It is advantageous if the preferential regions of the cars which can be made to travel along a common traveling path are assigned to the cars in such a way that mutually neighboring preferential regions overlap, at least on the level of one floor. This has the consequence that this floor, for example a parking deck, can be served with the same priority by at least two cars.

As an alternative, the preferential regions may be assigned to the cars without any overlap. For example, it may be envisaged for neighboring preferential regions to follow on directly from one another. At the interface of the two preferential regions, a double floor may be provided, so that a passenger starting from the double floor can select an upper preferential region or a lower preferential region, depending on whether he wishes to travel up or down.

The allocation assessment of the individual cars for serving a destination call may take place situation-dependently, that is to say dependent on the number of destination calls in existence at a time. As an alternative, the allocation assessment may be performed in dependence on the capacity utilization of the cars. Such an assessment permits what is known as "filling transport", which is aimed at distributing as many passengers as possible around a building in as short a time as possible from particularly frequented stops. For this purpose, it may be provided for example that the cars remain with open doors at an access stop, until either an adjustable load threshold of the cars is exceeded or an adjustable standing time has elapsed. This achieves the effect that the cars are better filled and consequently a higher transporting capacity is available. Such an allocation assessment may take place in a manner dependent on the time of day. For example, it may be provided that, on work days between 7 and 9 a.m., a utilization-dependent allocation assessment is carried out, with the access floor of the building, that is for example the first floor or a parking deck, being prescribed as the access stop of the cars. During the rest of the day, a situation-dependent allocation assessment may then be performed. It may also be provided that a further utilization-dependent allocation assessment is performed on work days, for example in the time between 12:30 and 1:30 p.m., with a canteen floor being prescribed as the access stop. In this way it is ensured that the users can leave the floor on which the canteen is located within a short time after visiting the canteen.

It is advantageous if the travel destinations of the car next arriving at the respective floor is indicated on an indicating device on the floors to be served by the elevator installation. In this way, the user receives an indication of which destinations are being served by the car next arriving at the floor. This has the advantage that, after entering his destination call, a user can check before entering the car whether it is the desired car for reaching his travel destination. Furthermore, such an indication makes it possible that a passenger need not necessarily enter a destination call if his travel destination coincides with one of the destinations already indicated. The passenger can consequently enter the car arriving straight away, eliminating the time taken up by entering the travel destination, whereby the transporting capacity of the elevator installation can once again be increased.

It may also be provided that not only the travel destinations of the car next arriving at the respective floor are indicated, but also the travel destinations of at least one further car arriving thereafter.

It is of particular advantage if, after a destination call has been entered, the expected time before the arrival or departure of the car serving the destination call is indicated. The passenger consequently obtains an indication of the expected waiting time.

After a destination call has been entered, it is provided in a preferred embodiment of the method according to the invention that, on an indicating unit associated with the input unit, the passenger is provided with an indication of the car allocated for serving his destination call. The passenger is consequently clearly allocated a quite specific car. If a number of cars can be made to travel along a common traveling path in one shaft, it may be provided for example that the cars are differently colored to distinguish between them.

As an alternative, in the case of an elevator installation with a number of shafts, it may be provided that the shaft with the stop at which the car serving the destination call will arrive next is indicated to the passenger on an indicating unit associated with the input unit. Such a procedure has the advantage that, after a destination call is entered, a destination call allocation performed in the first instance to a specific car can also be changed after the response to the passenger. It must simply be ensured after the response has been made to the passenger that the next car arriving at the stop of the shaft indicated serves the destination call which has been entered.

It is of particular advantage if each car has an associated control unit with a group control function, the control unit performing the allocation assessment for the associated car and all the control units being electrically connected to one another. Such a procedure makes it possible for the operation of the elevator installation to be particularly immune to faults, since it is possible to dispense with a higher-level central unit for controlling the cars. Rather, the control of all the cars can be performed with the aid of the decentralized control units, which respectively have a group control function. For this purpose, all the control units of the elevator installation are connected to one other in a wire-bound or wireless manner and all the cars are controlled by their interaction. The allocation assessment is performed by each control unit for the respectively associated car, and the results of the allocation assessments can be transmitted via the electrical connection to all the control units, so that the comparison of the allocation assessments can be performed by all the control units simultaneously. That control unit which detects on the basis of the comparison that the car associated with it has the best allocation assessment allocates the current destination call to itself and sends a corresponding allocation reply to the control unit which has read in the destination call. The other control units detect on the basis of their calculation that the destination call currently waiting to be served has been undertaken by the one control unit and the car associated with it.

As an alternative and/or in addition, it may be provided that at least the cars which can be made to travel along a common traveling path have an associated central group control unit, which can perform the allocation assessment of all the associated cars. If the group control unit is used in addition to the decentralized control units, the group control unit need not be of a redundant configuration, since, if it fails, the control of the cars and the allocation assessment are taken over by the decentralized control units. The group control unit preferably has a considerably higher computing capacity than the decentralized control units. This provides the possibility of detecting behavioral patterns of the passengers by means of the central group control unit, in order to be able to perform a corresponding allocation assessment of the cars. In particular, the central group control unit can perform by means of methods of "artificial intelligence" known per se a predictive allocation assessment, in order to be able to provide as high a transporting capacity as possible in dependence on the behavioral pattern of the passengers.

The invention also relates to an elevator installation, in particular for carrying out the method explained above, with the features stated at the beginning. To develop such an elevator installation in such a way that an improved transporting capacity can be achieved, with the cars which can be made to travel along a common traveling path hindering one another as little as possible, it is provided according to the invention that, when the destination call is allocated to one of the cars which can be made to travel along a common traveling path, the portion of the traveling path required by the allocated car to serve the destination call can be assigned to this car and that this portion of the traveling path is not accessible during the time of the assignment for the other cars which can be made to travel along the common traveling path. Such a configuration of the elevator installation makes it possible to assign a certain portion of the traveling path shared by a number of cars for a certain time, in dependence on the destination calls entered, to one of the cars which share the traveling path, so that this portion of the traveling path can be used only by this one car, while it is not accessible for a certain time for the other cars which can be made to travel along the common traveling path.

To make it possible for the cars using a common traveling path to have the greatest possible freedom of movement, it is provided in the case of a preferred embodiment of the elevator installation according to the invention that the portion of the traveling path assigned to one of the cars which can be made to travel along a common traveling path can be released floor by floor for the other cars when the destination call is served. If the car serving the destination call, which has been assigned a specific portion of the traveling path, leaves a floor, this floor can immediately be released again for the other cars, so that it is accessible to another car for serving a subsequent destination call.

It is of advantage if the control device of the elevator installation comprises a number of control units, respectively having a group control function, which are respectively associated with a car and are connected to one another via a data transmission system, it being possible for the allocation assessment for the respectively associated car to be carried out by means of the control units. The electrical connection of the control units may take place in a wire-bound or else wireless manner. It is of particular advantage if the data transmission system is configured as a BUS system. Alternatively, separate connecting lines may be used, it also being possible for a connection via light guides to be provided. A wireless connection may take place, for example, by radio.

In the case of a preferred embodiment of the elevator installation according to the invention, the control units which are associated with the cars which can be made to travel along a common traveling path are connected to one another via a separate data line. The control units have in each case a central calculating unit, and it has proven to be advantageous if the central calculating units of the control units are directly connected to one another via the separate data line. It is particularly advantageous if the separate data line has a higher data transmission rate than the data transmission system. This makes possible a particularly rapid coordination of the control units associated with the cars which can be made to travel along a common traveling path.

The input units disposed on the floors to be served by the elevator installation are preferably connected to at least one control unit via a data line. The data line may be of a wire-bound or wireless form, in particular in the form of a BUS system.

It is of particular advantage if the control device comprises a central group control unit associated at least with the cars which can be made to travel along a common traveling path, for carrying out the allocation assessment and for allocating a destination call to one of the cars. It is particularly advantageous in this respect if the control device has both control units that are respectively associated with a car and a central group control unit, it being possible for an allocation assessment and allocation of a destination call to be carried out optionally by the decentralized control units or by the central group control unit.

To be able to give a response to a passenger after a destination call has been entered, it is advantageous if the input units respectively have an associated indicating unit, for indicating the, car serving the destination call entered or the shaft with the stop at which the car will arrive, and preferably also for indicating the expected time until the arrival or departure of the car. Consequently, after entering a destination call, the passenger receives the information as to which car or which shaft he is to use and how long the expected waiting time will be.

The elevator installation according to the invention is preferably configured in such a way that it is possible for two cars to be made to travel up and down along a common traveling path in one shaft. Preferably, both these cars can travel to all the stops with the exception of the lowermost and uppermost stops.

In the case of a particularly preferred embodiment, the elevator installation comprises at least two shafts, it being possible for at least two cars to be made to travel along a common traveling path in a first shaft and for a single car to be made to travel along a traveling path from the lowermost stop to the uppermost stop in a second shaft. Such a configuration has the advantage that a user can be transported directly from the lowermost stop to the uppermost stop via the second shaft without changing cars, while a particularly high transporting capacity can be achieved in the first shaft for journeys in the region between the lowermost and the uppermost stops.

The following description of a preferred embodiment of the invention serves for further explanation in conjunction with the drawing.

DETAILED DESCRIPTION OF THE INVENTION

Figure 1:
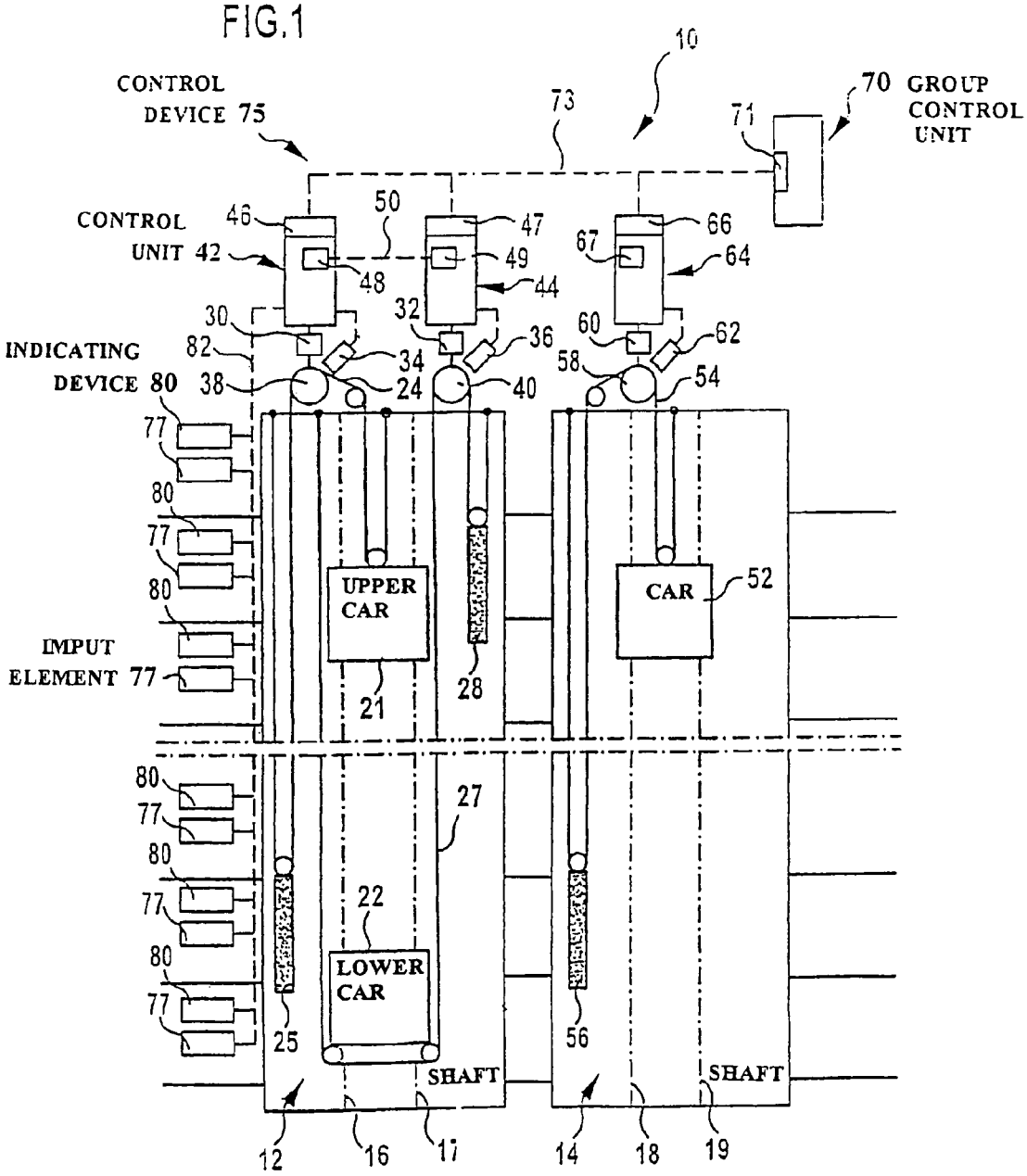
FIG. 1 shows a schematic representation of an elevator installation according to the invention.

Schematically represented in FIG. 1 is an elevator installation, which is provided overall with the reference numeral 10 and has a first shaft 12 and a second shaft 14, in each of which two guide rails 16, 17 and 18, 19 are respectively held. The two guide rails 16, 17 of the first shaft form a common traveling path for an upper car 21 and a lower car 22, which can be made to travel up and down along the guide rails 16 and 17. The upper car 21 is coupled to a counterweight 25 via a suspension rope 24, and the lower car 22 is coupled to a counterweight 28 via a suspension rope 27.

Each of the two cars 21 and 22 has an associated separate drive in the form of an electric drive motor 30 and 32, respectively, and in each case a separate brake 34 and 36, respectively. The drive motors 30, 32 in each case act on a traction sheave 38 and 40, respectively, over which the suspension ropes 24 and 27 are led.

The control of the cars 21 and 22 respectively takes place by means of a separate control unit 42 and 44, which have a group control element 46 and 47 and a central computing unit 48 and 49, respectively. The latter are connected directly to one another via a data line 50 configured in the form of a BUS system. The control units 42 and 44 are in electrical connection via control lines with the respectively associated drive motor 30 and 32 and also with the associated brake 34 and 36, so that the cars 21 and 22 can be made to travel up and down in the usual way within the first elevator shaft 12 for the transportation of persons and/or loads.

The second shaft 14 receives a single car 52, which can be made to travel along the guide rails 18 and 19 from a lowermost stop to an uppermost stop and is coupled to a counterweight 56 via a suspension rope 54, the suspension rope 54 being led over a traction sheave 58, which is coupled to a drive associated with the car 52 in the form of an electric drive motor 60. The car 52 has an associated separate brake 62, which in a way similar to the drive motor 60 is in electrical connection via a control line with a control unit 64 associated with the car 52. The control unit 54 comprises a group control element 66 and a central computing unit 67.

In addition to the control units 42, 44, 64 respectively associated with a car 21, 22 and 52, the elevator installation 10 may comprise a higher-level group control unit 70 with a connection element 71, with the aid of which the group control unit 70 can be connected to a data transmission system 73 which is configured as a BUS system and via which all the control units 42, 44, 64 of the elevator installation 10 are connected to one another.

The group control unit 70 forms in combination with the control units 42, 44 and 64 a control device, provided overall with the reference numeral 75 in FIG. 1, and can be used as an alternative to the control units 42, 44, 64 for controlling the elevator installation 10.

An input element with an integrated indicating element in the form of a touch-sensitive screen 77 is disposed on each floor which can be served by the elevator installation 10. Furthermore, an indicating device 80 is located on each floor in the region of the shaft 12 and 14. All the screens 77 and indicating devices 80 are connected to the control device 75 via an electrical connecting line 82 likewise configured as a BUS system. In the exemplary embodiment represented, the connecting line 82 is connected to the control unit 42, which is in electrical connection via the data transmission system 73 with the remaining control units 44 and 64 and also the group control unit 70 that can alternatively be used. By means of the touch-sensitive screens 77, a passenger can enter a destination call with a desired travel destination into the control device 75, which then performs an allocation assessment and allocates one of the cars 21, 22, 52 to the destination call to answer it. As a response to the input of the destination call, the passenger is provided on the touch-sensitive screen 77 with an indication of the car to be used, and the expected time until the arrival of the car may also be indicated. On the additional indicating device 80, the passenger is informed of the destinations to which the cars next arriving at the floor are to travel. If one of the travel destinations indicated coincides with the travel destination desired by the passenger, there is no need for him to enter a destination call. The expected time until the arrival of the next cars may also be indicated on the indicating device 80.

Figure 2:
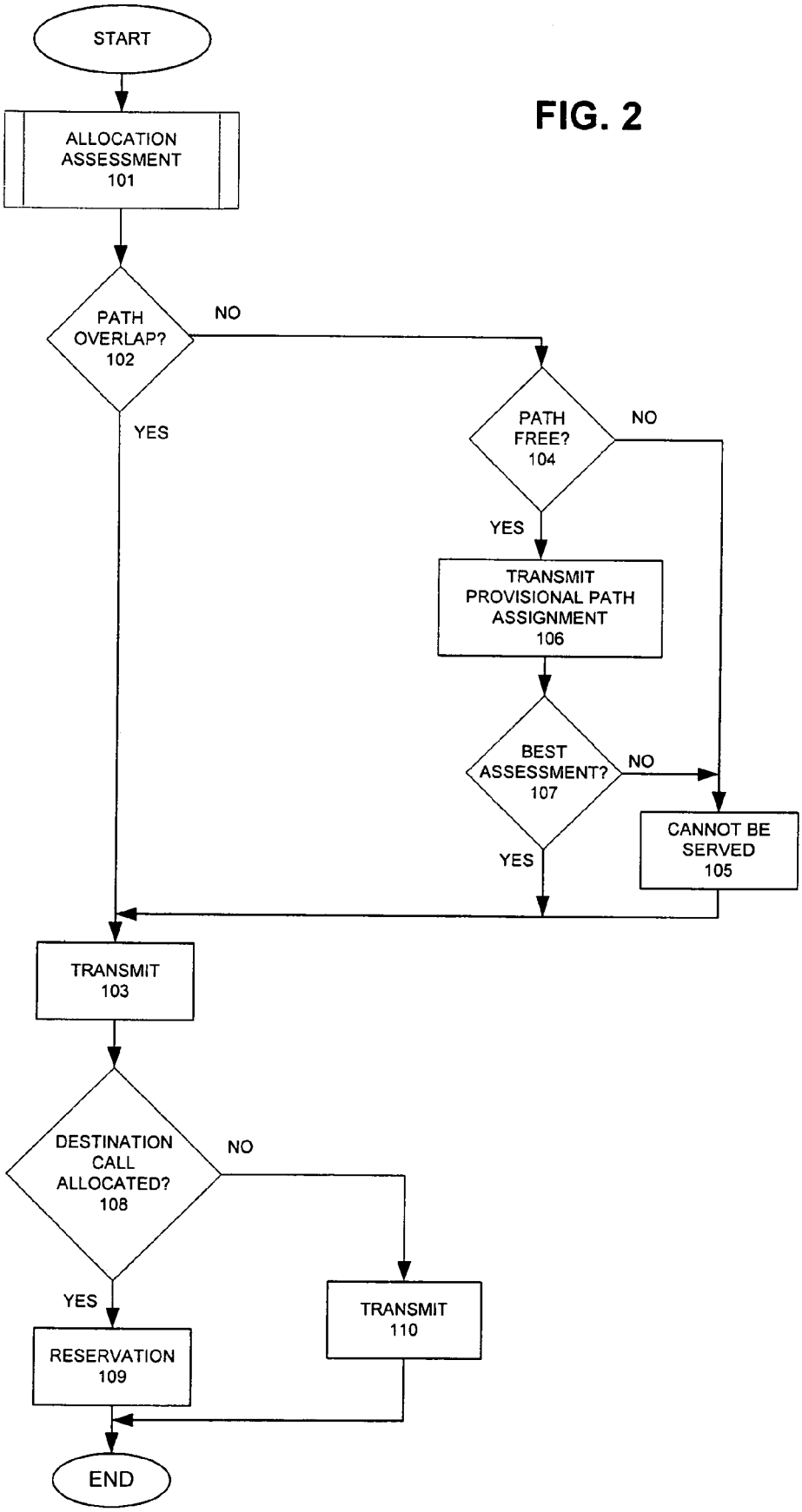
FIG. 2 shows a flow diagram of the method used according to the invention for controlling the elevator installation.

The allocation of a car to an entered destination call is explained in more detail below with reference to FIG. 2. An entered destination call is transmitted via the electrical connecting line 82 to the control unit 42 of the control device 75. The control unit 42 passes on the destination call via the data transmission system 73 to the remaining control units 44 and 64 of the elevator installation. Each control unit 42, 44 and 64 was allocated a number when the elevator installation 10 was installed, and the entered destination call is stored by all the control units 42, 44 and 64 respectively in a memory element which is known per se, and therefore not represented in the drawing, until the control unit with the smallest allocated number, for example the control unit 42, transmits the signal for assessing the entered destination call to all the control units via the data transmission system 73. In the method step 101 illustrated in FIG. 2, an allocation assessment of the entered destination call is then performed by all the control units 42, 44 and 64 for the respectively associated car 21, 22 and 52, on the basis of a prescribed assessment algorithm in dependence on the operating data and operating states of the respective car 21, 22 and 52, in order to ascertain the optimum car for serving the destination call with regard to the highest possible transporting capacity.

After the allocation assessment has been performed, it is checked in a method step 102 by the control units 42 and 44, which each have an associated car 21 and 22 respectively sharing the common traveling path 16, 17 with a further car 22 or 21, whether the portion of the traveling path required for serving the current destination call, that is to say the portion of the traveling path which, beginning from the current position of the respective car, extends via the starting point of the desired travel to the entered travel destination, overlaps at least partly a portion of the traveling path which has already been assigned to the respective car 21 or 22 in conjunction with a destination call entered earlier but not yet served to completion, that is to say has been "reserved" for this car. If one of the two control units 42, 44 establishes that the portion of the traveling path required for serving the current destination call overlaps a portion of the traveling path already assigned to the respective car, the respective control unit 42 or 44 transmits in the method step 103 the result of the allocation assessment carried out via the data transmission system 73 to the remaining control units of the elevator installation 10.

If the check in the method step 102 reveals that the portion of the traveling path required for serving the current destination call does not overlap a portion of the traveling path already assigned to the respective car on the basis of an earlier destination call, it is checked in a method step 104 by the control units 42 and 44 whether the portion of the traveling path required for serving the current destination call overlaps at least partly a portion of the traveling path for which at least a provisional assignment exists for the other of the two cars 21, 22 which can be made to travel along a common traveling path 16, 17, that is to say it is checked whether the portion of the traveling path required by the respective car 21 or 22 to serve the current destination call is completely free. If the required portion of the traveling path is not free for the respective car 21 or 22, that is to say there is a provisional or definitive assignment for the other car 22 or 21, respectively, the control unit 42 or 44 associated with this car sets the assessment to "cannot be served" in the method step 105 and transmits the information that the current destination call cannot be served by the respective car 21 or 22 via the data transmission system 73 to all the control units of the elevator installation 10 in the method step 103.

If the check in the method step 104 reveals that the portion of the traveling path required for serving the current destination call is free for the respective car 21 or 22, in the method step 106 the respective control unit 42 or 44 transmits via the direct data transmission line 50 to the other control unit of the cars 21, 22 which can be made to travel along the common traveling path 16, 17 a signal according to which the respectively required portion of the traveling path is provisionally assigned to the respective car 21 or 22. Subsequently, in the method step 107 it is checked by the control units 42 and 44 which of the two cars 21 and 22 has the better allocation assessment. For this purpose, the control units 42 and 44 transmit to one another the result of their allocation assessment via the data line 50 together with the provisional assignment of the portion of the traveling path, and respectively compare the results. The data transmission line 50 has for this purpose a data transmission rate which is higher than the data transmission rate of the data transmission system 73. As an alternative, transmission via the normal data transmission system 73 may of course be chosen instead of the transmission via an additional data line 50. The control unit 42 or 44 that is associated with the car with the better allocation assessment then transmits in the method step 103 the result of its own allocation assessment via the data transmission system 73 to the other control units of the elevator installation 10, while the control unit 42 or 44 with the associated car 21 or 22 that has the poorer allocation assessment sets the assessment to "cannot be served" in a way corresponding to the method step 105, and this is then transmitted via the data transmission system 73 in the method step 103.

In addition to one of the two control units 42 and 44, that is the control unit which already has a "reservation" for its car or has the better allocation assessment for its car, in the method step 103 the control unit 64 associated with the car 52 also transmits the result of its allocation assessment via the data transmission system 73. Consequently, after the method step 103, all the control units 42, 44 and 64 of the elevator installation 10 have the results of all the allocation assessments to be considered, so that subsequently a comparison of the allocation assessments and allocation of the current destination call can be performed by all the control units 42, 44 and 64. The control unit which receives the best allocation assessment for its car allocates the current destination call to itself and sends a corresponding allocation reply to the control unit 42, which has read in the destination call, and this control unit 42 then sends the allocation reply via the connecting line 82 to the touch-sensitive screen 77, on which the destination call was entered. On the screen 77, it is then indicated to the passenger which car 21, 22 or 52 or which shaft 12 or 14 he is to use and, if appropriate, how long it is expected to be before the desired car 21, 22 or 52 will arrive at the passenger's floor.

In the method step 108, the two control units 42, 44 then check whether the allocation of the current destination call was made to the respective car 21 or 22. If this question is answered in the affirmative, in the method step 109 the corresponding control unit 42 or 44 transmits a definitive allocation signal via the direct data transmission line 50 to the other control unit with the car which is sharing the shaft 12 with its own car, with regard to the portion of the traveling path required for serving the destination call. Consequently, the portion of the traveling path required for serving the current destination call is definitively assigned to the car 21 or 22, that is to say that in the method step 109 a definitive "reservation" is made of the portion of the traveling path required for serving the current destination call if one of the two cars 21 and 22 has the best allocation assessment.

The control unit 42 or 44 that establishes in the method step 108 that the destination call was not allocated to the respective car 21 or 22 sends in the method step 110 via the direct data transmission line 50 to the other control unit a signal according to which the provisional assignment of the respectively required portion of the traveling path which was performed in the method step 106 is cancelled again.

After carrying out the method steps 101 to 110, it is consequently clarified which of the cars 21, 22 and 52 of the elevator installation 10 is allocated a current destination call and whether in the case of an allocation to one of the cars 21 and 22 which can be made to travel along a common traveling path 16, 17 an assignment of the portion of the traveling path required for serving the destination call has been made, with the effect that this portion of the traveling path is not available to the other car 21 or 22 respectively when it is serving a subsequent destination call.

The invention claimed is:

1. Method for controlling an elevator installation with at least one shaft, a number of cars which each have an associated drive and brake, and at least two cars capable of traveling separately up and down along a common traveling path, comprising:

entering a destination call with a travel destination of a passenger by means of an input unit of a control device of the elevator installation disposed outside the at least one shaft;

performing an allocation assessment for each car;

comparing the allocation assessments of all the cars with one another to determine a best allocation assessment; and allocating the destination call to the car with the best allocation assessment to serve the destination call, wherein, in the case of allocation of the destination call to one of the cars which can be made to travel along a common traveling path, a portion of the traveling path required by the allocated car to serve the destination call is assigned to the allocated car and the assigned portion of the traveling path is blocked for a time of the assignment for the other cars which are capable of traveling along the common traveling path.

2. Method according to claim 1, wherein those cars for which the portion of the traveling path respectively required for serving the current destination call overlaps at least partly with a portion of a traveling path which has already been assigned to another car on the basis of an earlier, not yet served destination call are excluded from the comparison of the allocation assessments.

3. Method according to claim 2, wherein:

when the portion of the traveling path respectively required for serving a current destination call does not overlap any portion of a traveling path already assigned to a car, the allocation assessments of only the cars which are capable of travelling along the common traveling path are first compared with one another and then only the car with the best allocation assessment of these cars is used for the comparison with the allocation assessment of the remaining cars of the elevator installation.

4. Method according to claim 3, wherein:

each of the cars which are capable of traveling along a common traveling path is provisionally assigned the portion of the traveling path required to serve the current destination call, the results of the allocation assessments of these cars are compared with one another to determine the best allocation assessment, the provisional assignments of the portions of the traveling path is revoked with the exception of the car with the best allocation assessment, when the current destination call is allocated to the car capable of traveling along the common traveling path that has the best allocation assessment of these cars, this car is definitively assigned the respective portion of the traveling path, and when the current destination call is not allocated to this car, its provisional assignment of the respective portion of the traveling path is cancelled.

5. Method according to claim 4, wherein those cars for which the portion of the traveling path respectively required for serving a current destination call overlaps at least partly with a portion of a traveling path which has been provisionally assigned to one of the cars which are capable of traveling along the common traveling path on the basis of an earlier destination call not yet allocated to a specific car are excluded from the comparison of the allocation assessments of the cars which are capable of traveling along a common traveling path.

6. Method according to claim 1, wherein the portion of the traveling path which has been assigned to a car is released floor by floor for the other cars when the destination call is served.

7. Method according to claim 1, wherein at least one of the cars which are capable of traveling along a common traveling path is assigned a preferential region of the common traveling path and a position of the portion of the traveling path required for serving a destination call in relation to the respective preferential region is taken into consideration in the allocation assessment.

8. Method according to claim 7, wherein the preferential regions are assigned to the cars in such a way that mutually neighboring preferential regions overlap, at least on the level of one floor.

9. Method according to claim 7, wherein the preferential regions are assigned to the cars without any overlap.

10. Method according to claim 1, wherein the allocation assessment is performed in dependence on the number of destination calls in existence at a time.

11. Method according to claim 1, wherein the allocation assessment is performed in dependence on a capacity utilization of the cars.

12. Method according to claim 1, wherein travel destinations of the car next arriving at a respective floor is indicated on an indicating device on the floors to be served by the elevator installation.

13. Method according to claim 12, wherein the travel destinations of a number of cars arriving one after the other at the floor are indicated on the floors to be served by the elevator installation.

14. Method according to claim 1, wherein, after a destination call has been entered, an expected time before arrival or departure of the car serving the destination call is indicated.

15. Method according to claim 1, wherein, on an indicating unit respectively associated with an input unit, a passenger is provided with an indication of the car allocated for serving a destination call.

16. Method according to claim 1, wherein the shaft with a stop at which the car allocated to the destination call will arrive next is indicated on an indicating unit respectively associated with an input unit.

17. Method according to claim 1, wherein each car has an associated control unit with a group control function, the control unit performing the allocation assessment for the respectively associated car and all the control units being electrically connected to one another.

18. Method according to claim 1, wherein at least the cars which are capable of traveling along a common traveling path have an associated central group control unit, which can perform the allocation assessment of all the associated cars.

19. Elevator installation, comprising:

at least one shaft;

a number of cars which each have an associated drive and brake, at least two of said cars being capable of traveling separately up and down along a common traveling path;

input units disposed outside the at least one shaft for entering a destination call with a travel destination of a passenger; and a control device for controlling the cars, said control device adapted for:

carrying out an allocation assessment for the individual cars after each time a destination call is entered; and allocating the destination call to one of said cars based on a comparison of said allocation assessments, wherein when the destination call is allocated to one of the cars which are capable of traveling along a common traveling path, a portion of the traveling path required by the allocated car to serve the destination call is assigned to this car and the assigned portion of the traveling path is not accessible during a time of the assignment for the other cars which are capable of traveling along the common traveling path.

20. Elevator installation according to claim 19, wherein the portion of the traveling path assigned to one of the cars which are capable of traveling along a common traveling path can be released floor by floor for the other cars when the destination call is served.

21. Elevator installation according to claim 19, wherein:

the control device comprises a number of control units, respectively having a group control function, which are respectively associated with a car and are connected to one another via a data transmission system, and the allocation assessment for each associated car is carried out by means of the respective control units for each car.

22. Elevator installation according to claim 21, wherein the control units which are associated with the cars which are capable of traveling along a common traveling path are connected to one another via a separate data line.

23. Elevator installation according to claim 22, wherein the separate data line has a higher data transmission rate than the data transmission system.

24. Elevator installation according to claim 21, wherein the input units are connected to at least one control unit via a data line.

25. Elevator installation according to claim 19, wherein the control device comprises a central group control unit associated at least with the cars which are capable of traveling along a common traveling path, for carrying out the allocation assessment and allocating a destination call to a car.

26. Elevator installation according to claim 19, wherein the input units respectively have an associated indicating unit, for indicating the car serving the destination call entered and an expected time until arrival or departure of the car.

27. Elevator installation according to claim 19, wherein:

the elevator installation comprises at least two shafts, at least two cars are capable of traveling along a common traveling path in a first shaft, and a single car is capable of traveling along a traveling path from a lowermost stop to an uppermost stop in a second shaft.

* * * * *